US010916397B2

(12) United States Patent
Schaar

(10) Patent No.: US 10,916,397 B2
(45) Date of Patent: Feb. 9, 2021

(54) CONTROL DEVICE FOR AN ELECTROMAGNETIC DRIVE OF A SWITCHING APPARATUS

(71) Applicant: Eaton Intelligent Power Limited, Dublin (IE)

(72) Inventor: Ingo Schaar, Bonn (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 375 days.

(21) Appl. No.: 15/766,372

(22) PCT Filed: Oct. 6, 2016

(86) PCT No.: PCT/EP2016/073826
§ 371 (c)(1),
(2) Date: Apr. 6, 2018

(87) PCT Pub. No.: WO2017/063933
PCT Pub. Date: Apr. 20, 2017

(65) Prior Publication Data

US 2018/0301305 A1 Oct. 18, 2018

(30) Foreign Application Priority Data

Oct. 15, 2015 (DE) ..... 10 2015 117 593

(51) Int. Cl.
*H01H 47/32* (2006.01)
*H01H 47/00* (2006.01)

(52) U.S. Cl.
CPC ..... *H01H 47/325* (2013.01); *H01H 47/002* (2013.01)

(58) Field of Classification Search
CPC ..... H01H 47/04; H01H 47/325; H01H 50/44
See application file for complete search history.

(56) References Cited

U.S. PATENT DOCUMENTS 5,539,608 A * 7/1996 Hurley ..... G01R 31/3278 361/152
5,953,198 A * 9/1999 Murata ..... H01H 47/002 361/195

(Continued)

FOREIGN PATENT DOCUMENTS

CN 201348976 Y 11/2009
CN 204375656 U 6/2015

(Continued)

*Primary Examiner* — Fred E Finch, III
(74) *Attorney, Agent, or Firm* — Leydig, Voit & Mayer, Ltd.

(57) ABSTRACT

A control device for an electromagnetic drive of a switchgear includes: a power supply unit for generating a pick-up and a holding DC voltage for the electromagnetic drive of the switchgear, depending on a control signal; and a control unit for generating the control signal, which unit is designed to generate a second control signal for actuating a switch for joining or disconnecting the drive to or from the pick-up or holding DC voltage generated by the power supply unit. The power supply unit includes a switched-mode power supply unit that is designed for an input voltage range matched to an operating voltage range of the switchgear, the input voltage range being approximately 48 volts to approximately 240 volts, approximately 110 volts to approximately 240 volts, or approximately 24 volts to approximately 240 volts. The control unit is designed to generate the second control signal depending on a measuring voltage.

9 Claims, 2 Drawing Sheets

(56) References Cited

U.S. PATENT DOCUMENTS 6,583,997 B1* 6/2003 Reid ..... H02H 1/06 363/50
2002/0167777 A1 11/2002 Parisi et al.
2002/0186015 A1* 12/2002 Barbour ..... H01H 47/325 324/418
2004/0155638 A1* 8/2004 Flaherty ..... H01H 47/325 323/282
2006/0232907 A1* 10/2006 Huber ..... F25D 21/008 361/160
2009/0080133 A1* 3/2009 Chaudhuri ..... H01H 47/223 361/152
2009/0284889 A1 11/2009 Lenz
2013/0009464 A1 1/2013 Firehammer et al.
2014/0001832 A1* 1/2014 Grupido ..... B60L 3/12 307/9.1
2014/0043872 A1* 2/2014 Meid ..... H01F 7/1838 363/49
2014/0192571 A1 7/2014 Gasperi
2015/0348729 A1* 12/2015 Colby ..... H01H 47/04 361/160
2016/0035524 A1* 2/2016 Zulim ..... H01H 47/325 361/211
2017/0140888 A1* 5/2017 Cordle ..... H01F 7/1844

FOREIGN PATENT DOCUMENTS

DE 19516995 A1 11/1996
DE 10022342 A1 11/2001
DE 10227278 A1 1/2004
DE 102006005267 A1 8/2007
DE 102008018260 A1 10/2009
DE 102008023626 A1 11/2009
DE 102012221212 A1 7/2013
WO WO 2012055428 A1 5/2012
WO WO 2014044317 A1 3/2014

* cited by examiner

CONTROL DEVICE FOR AN ELECTROMAGNETIC DRIVE OF A SWITCHING APPARATUS

CROSS-REFERENCE TO PRIOR APPLICATIONS

This application is a U.S. National Phase application under 35 U.S.C. § 371 of International Application No. PCT/EP2016/073826, filed on Oct. 6, 2016, and claims benefit to German Patent Application No. DE 10 2015 117 593.2, filed on Oct. 15, 2015. The International Application was published in German on Apr. 20, 2017 as WO 2017/063933 under PCT Article 21(2).

FIELD

The invention relates to a control device for an electromagnetic drive of a switchgear, in particular a contactor, which is provided in order to supply energy to the drive, and a switchgear comprising a control device of this kind.

BACKGROUND

It is known that electromagnetic drives of switchgears such as contactors are supplied with different voltages depending on the drive mode. In pick-up operation, the coil of an electromagnetic drive is supplied with a pick-up voltage which generates a corresponding pick-up energy for applying the pick-up forces of the switchgear; as soon as the contacts of the switchgear are closed, the pick-up voltage can be lowered to a holding voltage in order to switch the drive to holding operation. The holding energy generated by the holding voltage is lower than the pick-up energy, since less energy is required for reliably "holding closed".

It is furthermore known to generate the pick-up and holding voltage by means of pulse width modulation (PWM); see for example the contactor actuator known from the German laid-open application DE 195 16 995 A1.

It is known from the German laid-open application DE 100 22 342 A1 to apply an unregulated supply voltage to a drive coil of an electromagnetic switchgear drive for a specified power-on time during pick-up operation, and to subsequently regulate the drive coil current during holding operation by reducing the supply voltage. For this purpose, a voltage regulator that can be controlled by a microprocessor is used.

The German laid-open application DE 102 27 278 A1 discloses a relay actuator comprising a control device having a voltage regulator controlled by an arithmetic unit. Upon activation, the voltage regulator first generates a minimum activation voltage for the relay. After activation, the voltage regulator reduces the supply voltage of the relay to a minimum holding voltage or increases the supply voltage to a full battery voltage.

The German laid-open application DE 10 2006 005 267 A1 describes a control device for a relay, which device comprises a switched-mode power supply unit, controlled by a microcontroller, for supplying voltage to the relay coils. The microcontroller controls the switched-mode power supply unit such that said power supply unit generates either a pick-up or a holding voltage.

Further control devices for electromagnetic drives in particular of relays are known from the German laid-open applications DE 10 2008 023 626 A1 and DE 10 2012 221 212 A1, and the US laid-open application US 2014/0192571 A1.

SUMMARY

In an embodiment, the present invention provides a control device for an electromagnetic drive of a switchgear, comprising: a power supply unit configured to generate a pick-up and a holding DC voltage for the electromagnetic drive of the switchgear, depending on a control signal; and a control unit configured to generate the control signal, which unit is configured to generate a second control signal for actuating a switch for joining or disconnecting the drive to or from the pick-up or holding DC voltage generated by the power supply unit, wherein the power supply unit comprises a switched-mode power supply unit that is configured for an input voltage range matched to an operating voltage range of the switchgear, the input voltage range being approximately 48 volts to approximately 240 volts, approximately 110 volts to approximately 240 volts, or approximately 24 volts to approximately 240 volts, and wherein the control unit is configured to generate the second control signal depending on a measuring voltage derived from an input voltage of the control device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
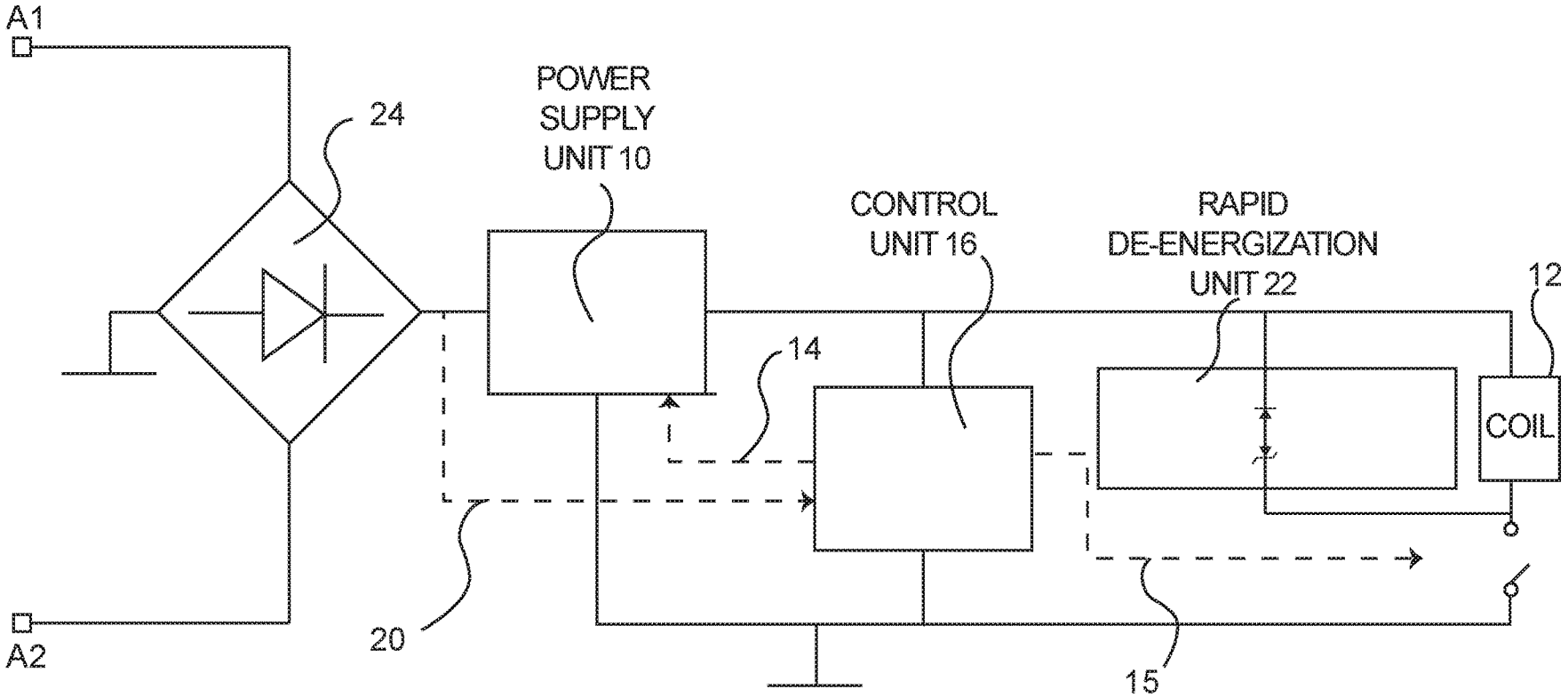
FIG. 1 is a functional block diagram of an embodiment of a control device for an electromagnetic drive of a switchgear according to the present invention.

A basic concept of the present invention consists in equipping a control device for an electromagnetic drive of a switchgear with a power supply unit that generates a pick-up and a holding DC voltage depending on a control signal generated by a control unit. The power supply unit can in addition be designed to supply voltage to the control unit. In contrast with PWM-based generation of the pick-up and holding voltage, using a power supply unit has the advantage that fewer problems arise regarding EMC (electromagnetic compatibility) of a switchgear, which problems are caused primarily by steep pulse edges in the case of PWM-based pick-up and holding voltage generation. A further advantage of the invention is also the fact that using a single power supply unit which generates a pick-up and holding DC voltage for the switchgear drive makes it possible, on account of the smaller space requirement, to achieve a relatively compact structure of the control electronics of a switchgear, as a result of which the EMC behavior can again be improved by smaller air gaps and leakage distances between individual components, and the number of components can be reduced.

One embodiment of the invention relates to a control device for an electromagnetic drive of a switchgear, comprising a power supply unit for generating a pick-up and a holding DC voltage for the electromagnetic drive of the switchgear depending on a control signal, and a control unit for generating the control signal. A control device of this kind allows for a compact structure of the control electronics of a switchgear, in particular of a contactor, since the energy for the pick-up operation and the power for the holding operation of the switchgear are generated by one power supply unit. Furthermore, the control unit is designed to generate a second control signal for actuating a switch for joining or disconnecting the drive to or from the pick-up or holding DC voltage generated by the power supply unit, depending on a measuring voltage derived from an input voltage of the control device. This can ensure, for example, that the drive can be brought into operation by generating a pick-up DC voltage only when a specified input voltage has been reached, and the power supply unit is thus not already loaded by the drive at low input voltages. Furthermore, the power supply unit is a switched-mode power supply unit designed for an input voltage range that is adjusted to the operating voltage range of the switchgear, the input voltage range being approximately 48 volts to approximately 240 volts, approximately 110 volts to approximately 240 volts or approximately 24 volts to approximately 240 volts. Using a power supply unit having a correspondingly large input voltage range can provide control electronics for a switchgear, which electronics can be used in a flexible manner. In particular when using a power supply unit having an input voltage range of from approximately 24 volts to approximately 240 volts, a multi-voltage switchgear can be provided, which switchgear is suitable for operation at a very wide range of supply voltages. This ultimately makes it possible to minimize the variants of switchgears.

In particular, the control unit can be designed to generate the control signal such that the power supply unit generates a pick-up DC voltage for the drive when at least one pick-up condition is met, and a holding DC voltage for the drive when at least one holding condition is met. The at least one pick-up condition can comprise a minimum input voltage and/or a minimum output voltage of the power supply unit being reached, and the at least one holding condition can comprise a specified time elapsing after the at least one pick-up condition has been met.

Furthermore, the control unit can be designed to generate the second control signal for actuating the switch in order to disconnect the drive from the pick-up or holding DC voltage generated by the power supply unit when the measuring voltage signals that a specified minimum voltage has not been reached. This can ensure that the power supply unit is safely separated from the drive and is no longer loaded thereby when the input voltage drops below the specified minimum voltage.

Furthermore, a rapid de-energization unit for de-energizing a coil of the drive can be provided, which unit is automatically activated when the coil is disconnected from the pick-up or holding DC voltage generated by the power supply unit. In particular, the rapid de-energizer can comprise a diode and a Zener diode that are connected in parallel with the coil of the drive, as a series circuit. The rapid de-energizer can thus be implemented with little outlay in terms of circuit engineering.

A further embodiment of the invention relates to a switchgear, in particular a contactor, having a switching drive that comprises a coil, and a control device according to the invention and as described herein for controlling the supply of power to the coil. The switchgear can also comprise a rectifier for generating a rectified output voltage from an alternating voltage in a specified input voltage range, the output voltage being supplied to the power supply unit of the control device.

The control unit of the control device can comprise a microprocessor or microcontroller that is configured, by a program stored in a memory, to generate a control signal for controlling the generation of a pick-up and a holding DC voltage by the power supply unit such that the power supply unit generates a pick-up DC voltage for the drive when pick-up conditions are met, and a holding DC voltage for the drive when holding conditions are met.

Further advantages and possible uses of the present invention are also found in the following description in conjunction with the embodiments shown in the drawings.

The terms and associated reference signs used in the list of reference signs set out below are used in the description, in the claims, in the abstract and in the drawings.

In the following description, the same, functionally similar and functionally related elements can be provided with the same reference signs. Absolute values are specified in the following only by way of example and are not to be understood as limiting the invention.

FIG. 1 is a functional block diagram of a control device or control electronics according to the invention which is designed, in principle, for a broad input voltage range and can be implemented in a compact manner on a circuit board. The control device is suitable, for example, for integration in a switchgear such as a contactor. Said device makes it possible to generate the energy for the pick-up and holding operation of an electromagnetic switchgear drive from a power supply unit, in particular without using PWM (on the drive), as a result of which the EMC behavior can be improved.

The control device comprises a power supply unit 10, a control unit 16, for example implemented by a microcontroller comprising a memory, a rapid de-energization unit 22 and a controllable switch 18. Strictly speaking, the rectifier 24 shown in FIG. 1 is not part of the control device but can nevertheless be provided on a circuit board of the control device. All the voltages and signals of the control device relate to a reference potential (e.g. ground).

The rectifier 24 is powered by a voltage applied at the terminals A1 and A2, for example an alternating voltage (within or also outside the conventional 50 Hz or 60 Hz) or a DC voltage. The output voltage generated by the rectifier 24 from the voltage powers the power supply unit 10 which generates therefrom an output voltage for supplying power to the control unit 16 and a coil 12 of an electromagnetic drive of a switchgear. The rapid de-energization unit 22 is connected in parallel with the coil 12. The controllable switch 18, for example a switching transistor having corresponding current-carrying capacity and suitability for the voltages that occur, is connected between the coil 12 and the ground.

Figure 2:
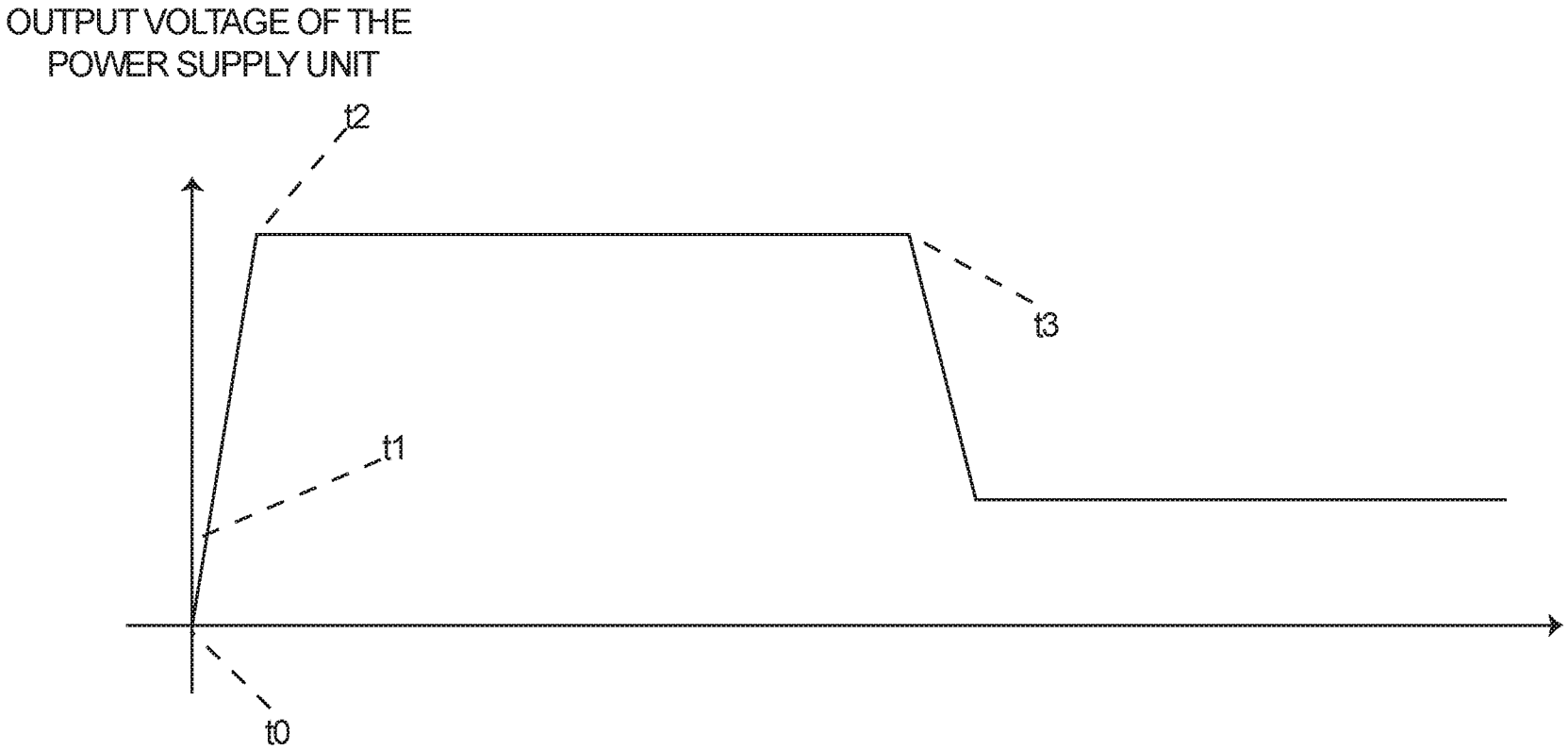
FIG. 2 is a time-dependency diagram of a curve, shown by way of example, of the output voltage, for supplying power to the drive, generated by the power supply unit of an embodiment of a control device for an electromagnetic drive of a switchgear according to the present invention.

The function of the control device will now be explained with reference to the time-dependency diagram, in FIG. 2, of a curve, shown by way of example, of the output voltage, generated by the power supply unit 10, for supplying power to the coil 12 of the drive:

In order to start the control device, a voltage in the specified input voltage range is applied at the terminals A1 and A2 (time point t=t0 in the time-dependency diagram). The output voltage generated by the rectifier 24 from the applied voltage is fed, on the input side, to the power supply unit 10 which generates therefrom an output DC voltage which increases with time and the curve of which, by way of example, is shown in the time-dependency diagram of FIG. 2.

As soon as the output voltage of the power supply unit 10 is sufficient for supplying power to the control unit 16 (time point t1 in the time-dependency diagram), control is started, in particular in that a microcontroller implementing the control unit 16 begins to execute firmware stored in its memory.

When the control unit 16 is operating, it measures a measuring voltage 20 derived from the voltage generated by the rectifier 24. For example, a voltage divider can be used to derive the measuring voltage 20 from the voltage generated by the rectifier 24 which, depending on the input voltage, may have very high values that may be too high to be directly processed by the control unit 16.

The control unit 16 controls the joining or disconnection of the coil 12 of the drive to or from the voltage supply of the power supply unit 10 depending on the measuring voltage 20. If the measuring voltage 20 exceeds a specified minimum voltage, by means of a corresponding second control signal 15 the control unit can connect the coil 12, by means of the controllable switch 18, into the supply path of the power supply unit 10, in that the connection between the coil 12 and the ground is closed. Conversely, the control unit 16 uses the second control signal 15 to switch off the supply of power to the coil 12, in that said unit opens the switch 18 if the measuring voltage falls below the specified minimum voltage. In this case, the specified minimum voltage is determined depending on parameters of the drive.

The control unit 16 then continues to monitor the output DC voltage that is generated by the power supply unit 10 and that continues to increase. As soon as the output DC voltage exceeds a minimum value that is sufficient for pick-up operation of the switchgear and is specified, a pick-up condition is met (time point t2 in the time-dependency diagram), and the control unit 16 generates a control signal 14 such that the power supply unit 10 is switched, by the control signal 14, into a mode in which it then generates and emits the output DC voltage reached as the pick-up DC voltage for the switching drive of the switchgear. Furthermore, the control unit 16 then generates the second control signal 15 such that the controllable switch 18 is closed, as a result of which the coil 12 can be connected to the ground and can thus be supplied with power by the pick-up DC voltage of the power supply unit 10, such that a corresponding pick-up current flows through the coil 12 and the drive of the switchgear is moved in order to close the switching contacts.

Approximately at time point t2, a timer is started in the control unit 16, which timer runs a specified time after the generation of the control signal 14 for generating and emitting the pick-up DC voltage. In this case, the specified time is measured depending on the switching drive and the duration so as to comprise the time until the switching contacts of the switchgear are closed (which typically corresponds to approximately the pick-up time of the switching drive).

When the timer has run out, and thus the time specified thereby has elapsed, a holding condition is met, and the control unit 16 generates the control signal 14 such that the power supply unit 10 is switched, by the control signal 14, into a mode in which it then generates and emits, as the output DC voltage, a holding DC voltage for the switching drive of the switchgear, which holding DC voltage is lower than the pick-up DC voltage (time point t3 in the time-dependency diagram). In practice, in this case the power supply unit 10 reduces its output DC voltage to the holding DC voltage and then emits the holding DC voltage for as long as a voltage in the specified input voltage range is applied at the terminals A1 and A2 and the switching contacts of the switchgear are intended to remain closed.

If the voltage at the terminals A1 and A2 is switched off or drops below the specified minimum voltage, which the control unit 16 can detect from the measuring voltage 20, the control unit 16 switches off the switching drive by generating and emitting the second control signal 15 such that the controllable switch 18 is opened. After the switch 18 has been opened, the rapid de-energizer 22, via which the energy stored in the coil 12 is discharged, automatically becomes active.

Advantages of the present invention consist in simplifying the circuitry of the control device, a robustness generally associated therewith, a possible minimization of the circuit variants, an improvement of the EMC behavior, and the possibility of implementing a multi-voltage switchgear that is suitable for a large input voltage range. Further advantages can be considered to be that the coil types of the electromagnetic drive of a switchgear can be reduced, since it is no longer necessary to use a separate coil for every input voltage range but instead one coil can be used for a plurality of input voltage variants, the number of components can be reduced, and a more compact structure is made possible, which structure results in smaller air gaps and leakage distances and thus improved EMC behavior, and also requires less space.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A control device for an electromagnetic drive of a switchgear, comprising:

a power supply unit configured to generate a pick-up DC voltage and a holding DC voltage for the electromagnetic drive of the switchgear, depending on a first control signal; and a control unit configured to generate the first control signal, which control unit is configured to generate a second control signal for actuating a switch for joining or disconnecting the electromagnetic drive to or from the pick-up DC voltage or holding DC voltage generated by the power supply unit, wherein the power supply unit is a switched-mode power supply unit that is configured for an input voltage range matched to an operating voltage range of the switchgear, the input voltage range being approximately 48 volts to approximately 240 volts, approximately 110 volts to approximately 240 volts, or approximately 24 volts to approximately 240 volts, and wherein the control unit is configured to generate the second control signal depending on a measuring voltage derived from an input voltage of the control device.

2. The control device according to claim 1, wherein the control unit is configured to generate the first control signal such that the power supply unit generates the pick-up DC voltage for the electromagnetic drive when at least one pick-up condition is met, and the holding DC voltage for the electromagnetic drive when at least one holding condition is met.

3. The control device according to claim 2, wherein the at least one pick-up condition comprises a minimum input voltage and/or a minimum output DC voltage of the power supply unit being reached, and wherein the at least one holding condition comprises a specified time elapsing after the at least one pick-up condition has been met.

4. The control device according to claim 1, wherein the control unit is configured to generate the second control signal for actuating the switch in order to disconnect the electromagnetic drive from the pick-up or holding DC voltage generated by the power supply unit when the measuring voltage signals that a specified minimum voltage has not been reached.

5. The control device according to claim 1, further comprising:

a rapid de-energization unit configured to de-energize a coil of the electromagnetic drive, which rapid de-energization unit is configured to be automatically activated when the coil is disconnected from the pick-up DC voltage or the holding DC voltage generated by the power supply unit.

6. The control device according to claim 5, wherein the rapid de-energization unit comprises a diode and a Zener diode that are connected in parallel with the coil of the electromagnetic drive, as a series circuit.

7. A switchgear, comprising:

a switching drive comprising a coil; and a control device configured to control a supply of power to the coil, the control device comprising:

a power supply unit configured to generate a pick-up DC voltage and a holding DC voltage for the switching drive, depending on a first control signal; and a control unit configured to generate the first control signal, which control unit is configured to generate a second control signal for actuating a controllable switch for joining or disconnecting the switching drive to or from the pick-up DC voltage or holding DC voltage generated by the power supply unit, wherein the power supply unit is a switched-mode power supply unit that is configured for an input voltage range matched to an operating voltage range of the switchgear, the input voltage range being approximately 48 volts to approximately 240 volts, approximately 110 volts to approximately 240 volts, or approximately 24 volts to approximately 240 volts, and wherein the control unit is configured to generate the second control signal depending on a measuring voltage derived from an input voltage of the control device.

8. The switchgear according to claim 7, wherein the control unit of the control device comprises a microprocessor or microcontroller that is configured, by a program stored in a memory, to generate the first control signal for controlling generation of the pick-up DC voltage and the holding DC voltage by the power supply unit such that the power supply unit generates the pick-up DC voltage for the coil when pick-up conditions are met, and the holding DC voltage for the coil when holding conditions are met.

9. The switchgear according to claim 7, wherein the switchgear is a contactor.

* * * * *